United States Patent [19]

Schumacher et al.

[11] 4,121,798

[45] Oct. 24, 1978

[54] UTENSIL HANDLE HOLDER

[76] Inventors: Donavon J. Schumacher, 421-13th Ave. West; Francis C. Hoffelt, 710-12th St. West, both of Williston, N. Dak. 58801

[21] Appl. No.: 806,995

[22] Filed: Jun. 16, 1977

[51] Int. Cl.[2] ..... A46B 17/02

[52] U.S. Cl. ..... 248/113; 24/81 WR; 248/229

[58] Field of Search ..... 248/113, 229, 37.3, 248/37.6, 216.2, 216.1; 24/81 B, 81 BA, 81 A, 81 H, 81 TH, 81 WR

[56] References Cited

U.S. PATENT DOCUMENTS

| | | | |
|---|---|---|---|
| 377,526 | 2/1888 | Levy | 248/229 X |
| 625,435 | 5/1899 | Clark | 248/37 |
| 884,256 | 4/1908 | Addie | 24/81 PH |
| 999,658 | 8/1911 | Knierieman | 248/113 X |
| 1,546,228 | 7/1925 | Gray | 24/81 PH |
| 2,460,136 | 1/1949 | Leonard | 248/113 X |
| 2,489,875 | 11/1949 | Embree | 248/113 |
| 2,675,979 | 4/1954 | Vetterli et al. | 248/113 |
| 2,713,469 | 7/1955 | Wright | 248/229 |
| 2,807,431 | 9/1957 | McHale | 248/113 |

*Primary Examiner*—Roy D. Frazier
*Assistant Examiner*—Peter A. Aschenbrenner
*Attorney, Agent, or Firm*—Merchant, Gould, Smith, Edell, Welter & Schmidt

[57] ABSTRACT

A holder for supporting elongated handles of utensils in a generally vertical position, and including a clip portion for grasping a handle, and a mounting portion comprising a pair of spaced flanges, and which may be mounted in straddling relationship to the upper edge portion of a container wall, partition or the like. Selectively, the mounting portion is adapted to be secured to a wall or panel.

2 Claims, 5 Drawing Figures

FIG. 1
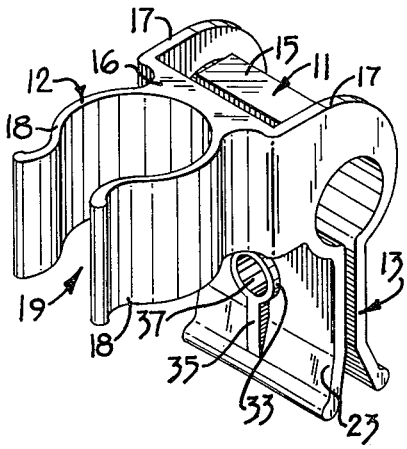
FIG. 2
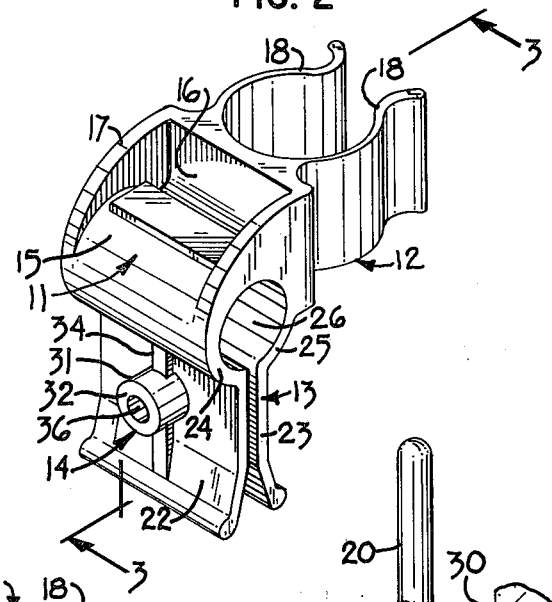
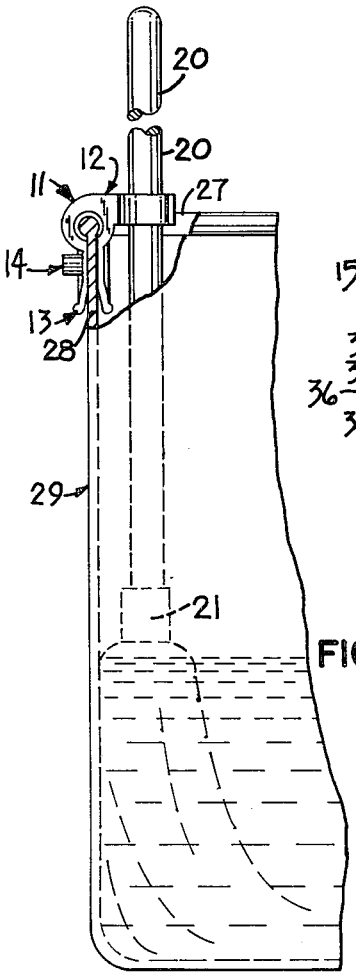
FIG. 4
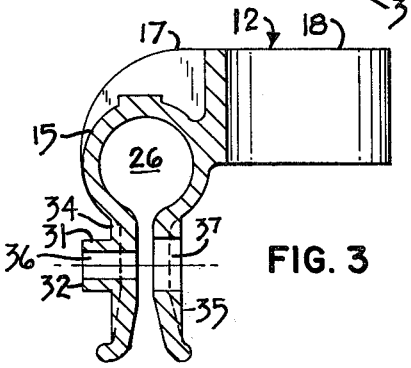
FIG. 3
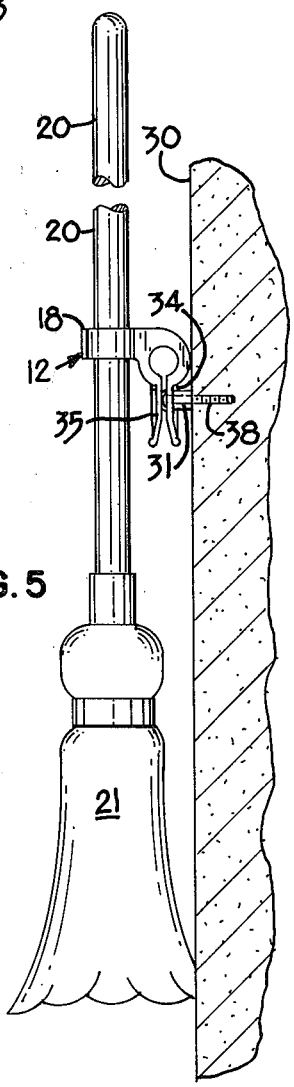
FIG. 5

UTENSIL HANDLE HOLDER

BACKGROUND OF THE INVENTION

This invention relates generally to holders for various utensils, and more particularly to holders for utensils having long handles, such as mops or brooms, to support the same in a generally vertical position. Such holders are advantageous in supporting a mop in a pail when the pail is moved about in use, and in supporting the mop in a vertical position for drying after use. Holders or clips heretofore produced are used generally for holding pencils, spoons, brushes and the like, and are adapted to be mounted or secured to a supporting structure in a single given manner. Examples of such prior art holders are found in U.S. Pat. Nos. 624,435; 884,256; 1,546,228; 2,489,875 and 2,713,469.

SUMMARY OF THE INVENTION

In accordance with the present invention, a utensil handle holder is provided which includes a rigid main body portion, a handle supporting clip portion comprising a pair of laterally spaced jaws projecting generally horizontally outwardly from said main body portion, at least one of said jaws being resilient, and a mounting portion comprising a pair of mounting flanges extending downwardly from said body portion, said mounting flanges being spaced apart in a direction generally normal to the direction of spacing of said jaws. One of said flanges has an abutment portion thereon, said abutment portion having an opening therethrough and an outer surface disposed in a common generally vertical plane with a surface of said body portion opposite said clip portion.

BRIEF DESCRIPTION OF THE DRAWINGS

FIG. 1 is a view in perspective showing the top and one side and end of a utensil handle holder produced in accordance with this invention;

FIG. 2 is a view in perspective showing the top and opposite side and end of the holder of FIG. 1;

FIG. 3 is a transverse section taken on the line 3—3 of FIG. 2;

FIG. 4 is a fragmentary view in side elevation of a container, showing the holder of this invention mounted on the container and supporting a utensil; and FIG. 5 is a fragmentary view partly in side elevation and partly in vertical section, showing the holder of this invention as mounted on a building wall.

DETAILED DESCRIPTION OF THE PREFERRED EMBODIMENT

The holder of the present invention is molded in a single piece of suitable material, such as synthetic plastic material to provide a body portion indicated generally at 11, a handle supporting clip portion indicated generally at 12, and a mounting portion indicated generally at 13. The mounting portion 13 includes an abutment portion 14.

The body portion 11 comprises a cross sectionally arcuate wall portion 15, a vertical wall portion 16 extending upwardly from one side of the arcuate wall portion 15, and a pair of vertically disposed stiffening ribs 17 each integrally formed with an opposite end of the arcuate wall portion 15 and a respective end of the vertical wall portion 16.

The vertical wall 16 provides a base for the clip portion 12, said clip portion including a pair of laterally spaced resilient jaws 18 that project generally horizontally outwardly from the vertical wall 16 and which cooperate to define a cross sectionally generally circular notch-like opening 19 for reception of the handle of a utensil, such as a mop, broom or other long-handled utensil or tool. In FIGS. 4 and 5, a mop handle is indicated at 20, the same being shown as provided with a conventional mop head 21. As shown, the jaws 18 are arranged to dispose the opening 19 thereof on a vertical axis, to support the handle 20 in a generally vertical disposition. The resiliency of the jaws 18 permits the handle 20 to be moved laterally into or out of the opening 19, and to yieldingly hold the same therein against accidental removal.

The mounting portion 13 comprises a pair of laterally spaced mounting flanges 22 and 23 that extend downwardly from the body portion 11, the flanges 22 and 23 having resilient cross sectionally arcuate upper end portions 24 and 25 respectively that are integrally formed with the arcuate wall 15, and which cooperate therewith to define a cross sectionally generally circular opening 26, the axis of which is generally horizontal. At their lower end portions, the mounting flanges 22 and 23 diverge downwardly to engage the holder to be placed over the upper beaded edge 27 of the side wall 28 of a conventional mop pail or other container, indicated generally at 29, with the mounting flanges straddling the side wall 28 and the beaded edge 27 being received in the opening 26. The resiliency of the upper end portions 24 and 25 of the mounting flanges 22 and 23 respectively permits the holder to be easily applied to the container 29. It will be noted that the mounting flanges 22 and 23 are spaced apart in a direction normal to the direction of spacing of the jaws 18 so that, when the holder is mounted on the container 29, the clip portion 12 supports the utensil within the container 29.

The abutment portion 14 adds utility to the holder by enabling the same to be mounted on a vertical panel or wall, as shown in FIG. 5, the panel or wall being indicated at 30. The abutment portion comprises a generally cylindrical boss 31 integrally formed with the flange 22 and having an end abutment surface 32 that is disposed in a vertical plane tangent to the arcuate wall 15 opposite the clip portion 12 of the body portion 11. A similar boss 33 is formed on the mounting flange 23, differing from the boss 31 in that the boss 33 is of shorter axial length. The bosses 31 and 33 cooperate with respective vertically extended ribs 34 and 35 to add rigidity to the flanges 22 and 23 below the arcuate upper portions 24 and 25 thereof. The bosses 31 and 33 are formed to provide respective axial openings 36 and 37 therethrough for reception of a mounting screw 38, whereby the holder may be secured to the wall 30, see FIG. 5. It will be noted that the opening 36 is of a diameter to admit the shank of the screw 38, the opening 37 being sufficiently larger in diameter to permit free passage of the head of the mounting screw 38 therethrough.

From the above, it will be apparent that the holder of this invention may be conveniently secured to a vertical wall or panel, as shown in FIG. 5, or selectively mounted on the upper rim portion of a mop pail or like container, or the upper edge of any generally vertical wall portion of mop wringing mechanism within the container 29, if desired. Further, while a preferred embodiment of utensil handle holder is shown and described, it will be understood that the same is capable of modification without departure from the spirit and scope of the invention, as defined in the claims.

What is claimed is:

1. A utensil handle holder including:

(a) a rigid main body portion;

(b) a handle supporting clip portion comprising a pair of laterally spaced jaws projecting generally horizontally outwardly from said main body portion, at least one of said jaws being resilient;

(c) a mounting portion comprising a pair of mounting flanges extending downwardly from said body portion, said mounting flanges being spaced apart in a direction generally normal to the direction of spacing of said jaws;

(d) an abutment portion comprising a boss on one of said flanges, said boss having an opening therethrough transversely of said one of said flanges and an outer surface disposed in a common generally vertical plane with a surface of said body portion opposite said clip portion;

(e) and a second boss on the other of said flanges aligned with said first mentioned boss, said second boss having an axial opening therethrough aligned with said first mentioned opening.

2. A utensil handle holder including:

(a) a rigid main body portion;

(b) a handle supporting clip portion comprising a pair of laterally spaced jaws projecting generally horizontally outwardly from said main body portion, at least one of said jaws being resilient;

(c) a mounting portion comprising a pair of mounting flanges extending downwardly from said body portion, said mounting flanges being spaced apart in a direction generally normal to the direction of spacing of said jaws;

(d) an abutment portion on one of said flanges, said abutment portion having an opening therethrough transversely of said one of said flanges and an outer surface disposed in a common generally vertical plane with a surface of said body portion opposite said clip portion;

(e) said mounting flanges being rigid for the greater portion of their generally vertical length, at least one of said flanges including a resilient upper end portion integral with said rigid body portion;

(f) said body portion including a cross sectionally arcuate wall portion at the upper ends of said mounting flanges, a vertical wall portion projecting upwardly from said arcuate wall portion at one end of said jaws and integral therewith, and a pair of spaced stiffening ribs each integrally formed with an opposite end of said arcuate wall portion and with a respective end of said vertical wall portion.

* * * * *